US007971361B2

(12) United States Patent
Fukinuki et al.

(10) Patent No.: US 7,971,361 B2
(45) Date of Patent: Jul. 5, 2011

(54) PORTABLE CIRCULAR SAW

(75) Inventors: Masatoshi Fukinuki, Nanjing (CN); Zhiguo Chen, Nanjing (CN)

(73) Assignee: Chervon Limited, Hong Kong (HK)

( * ) Notice: Subject to any disclaimer, the term of this patent is extended or adjusted under 35 U.S.C. 154(b) by 346 days.

(21) Appl. No.: 12/109,654

(22) Filed: Apr. 25, 2008

(65) Prior Publication Data

US 2008/0295345 A1 Dec. 4, 2008

(30) Foreign Application Priority Data

May 31, 2007 (CN) ..... 2007 2 0039446 U

(51) Int. Cl.
*B27B 9/04* (2006.01)

(52) U.S. Cl. ..... 30/373; 30/388

(58) Field of Classification Search ..... 30/371, 30/373, 374, 375, 388, 391
See application file for complete search history.

(56) References Cited

U.S. PATENT DOCUMENTS

| | | | | |
|---|---|---|---|---|
| 3,043,351 | A * | 7/1962 | Davis | 30/373 |
| 3,262,472 | A * | 7/1966 | McCarty et al. | 30/376 |
| 3,277,934 | A * | 10/1966 | Yelpo | 30/376 |
| 3,927,475 | A * | 12/1975 | Chang | 33/42 |
| 4,856,394 | A | 8/1989 | Clowers | |
| 5,414,935 | A | 5/1995 | Braunbach et al. | |
| 6,708,411 | B2 * | 3/2004 | Kani | 30/376 |
| 6,757,981 | B2 * | 7/2004 | Hampton | 30/372 |

* cited by examiner

*Primary Examiner* — Stephen Choi
(74) *Attorney, Agent, or Firm* — Gary R. Jarosik

(57) ABSTRACT

A portable circular saw has a housing and a baseplate. The housing carries a motor which is connected to a blade through a transmission mechanism. The baseplate includes a main baseplate and a secondary baseplate each of which has a bottom surface and the bottom surfaces are coplanar. At least a part of the blade passes though a slot formed in the main baseplate. The main baseplate includes a first edge and a second edge disposed on opposing sides of the blade. The secondary baseplate has at least two exchangeable positions. In a first position, the secondary baseplate is jointed or adjacent to the first edge of the main baseplate and, in a second position, the secondary baseplate is joined or adjacent to the second edge of the main baseplate.

12 Claims, 5 Drawing Sheets

PORTABLE CIRCULAR SAW

BACKGROUND

The following disclosure generally relates to a cutting tool and, more particularly, relates to a portable circular saw which has a transformable baseplate.

Generally, a circular saw includes a baseplate, a blade, a power source and a power transmission mechanism. The baseplate is perpendicular to the blade or is preferred to be adjustable relative thereto. The baseplate is usually made of an integral material. The blade goes through a slot formed on the baseplate and divides the baseplate into two parts with different widths. The part of the baseplate adjacent to which the power source and the transmission mechanism is disposed is wider than the other.

Due to the unchangeable shape of the baseplate and unchangeable widths of the two parts of the baseplate, sometimes it is not easy to operate the saw. For example, referring to FIG. 1, when a workpiece W1 is to be cut along a cutting line L1, a right-handed operator places a portable circular saw on a position as shown on the left side of FIG. 1. For a left-handed operator, another position as shown on the right side of FIG. 1 would be more suitable for him. However, the contact surface between the baseplate 20 and the workpiece W1 is too small for the circular saw to be supported on the workpiece, and it is difficult for the left-handed operator to control cutting operation.

Referring now to FIG. 2, when a relative small workpiece W2 is fastened by a fastener 30 and is to be cut along a cutting line L2, a cutting position as shown on the left side of FIG. 2 may be unavailable because of the interference of the fastener 30. Moreover, if the circular saw is placed in a position as shown on the right side of FIG. 2 to perform a cutting operation, the small contact surface between the baseplate 20 and the workpiece W2 also causes the same operation problems.

SUMMARY

The following describes a portable circular saw which has a transformable baseplate based on different cutting condition. To this end, the portable circular saw comprises a housing containing a motor, a transmission mechanism for transmitting rotation of the motor to a blade, and a baseplate connected to the housing which includes a first baseplate and a second baseplate wherein the first baseplate has a first bottom surface the second baseplate has a second bottom surface and at least a part of the blade passes through a slot formed in the first baseplate, wherein the first baseplate includes a first edge and a second edge located on opposing sides of the blade and the second baseplate has at least two exchangeable positions whereby, in a first position, the second baseplate is jointed or adjacent to the first edge of the first baseplate and, in a second position, the secondary baseplate is joined or adjacent to the second edge of the main baseplate, and wherein the first bottom surface and the second bottom surface are coplanar. In this manner, a portable circular saw is provided that is suitable for either a right-handed operator or a left-handed operator since the second baseplate could be disposed on either side of the first baseplate. Such as a structure also increases the operation stability in some special cutting circumstance, decreases the operation risks, and makes the cutting operation more comfortable.

A better appreciation of the objects, advantages, features, properties, and relationships of the disclosed tool will be obtained from the following detailed description and accompanying drawings which set forth illustrative embodiments which are indicative of the various ways in which the principles described hereinafter may be employed

BRIEF DESCRIPTION OF THE DRAWINGS

For use in better understanding the subject portable circular saw described hereinafter reference may be had to the following drawings in which.

DETAILED DESCRIPTION

Figure 3:
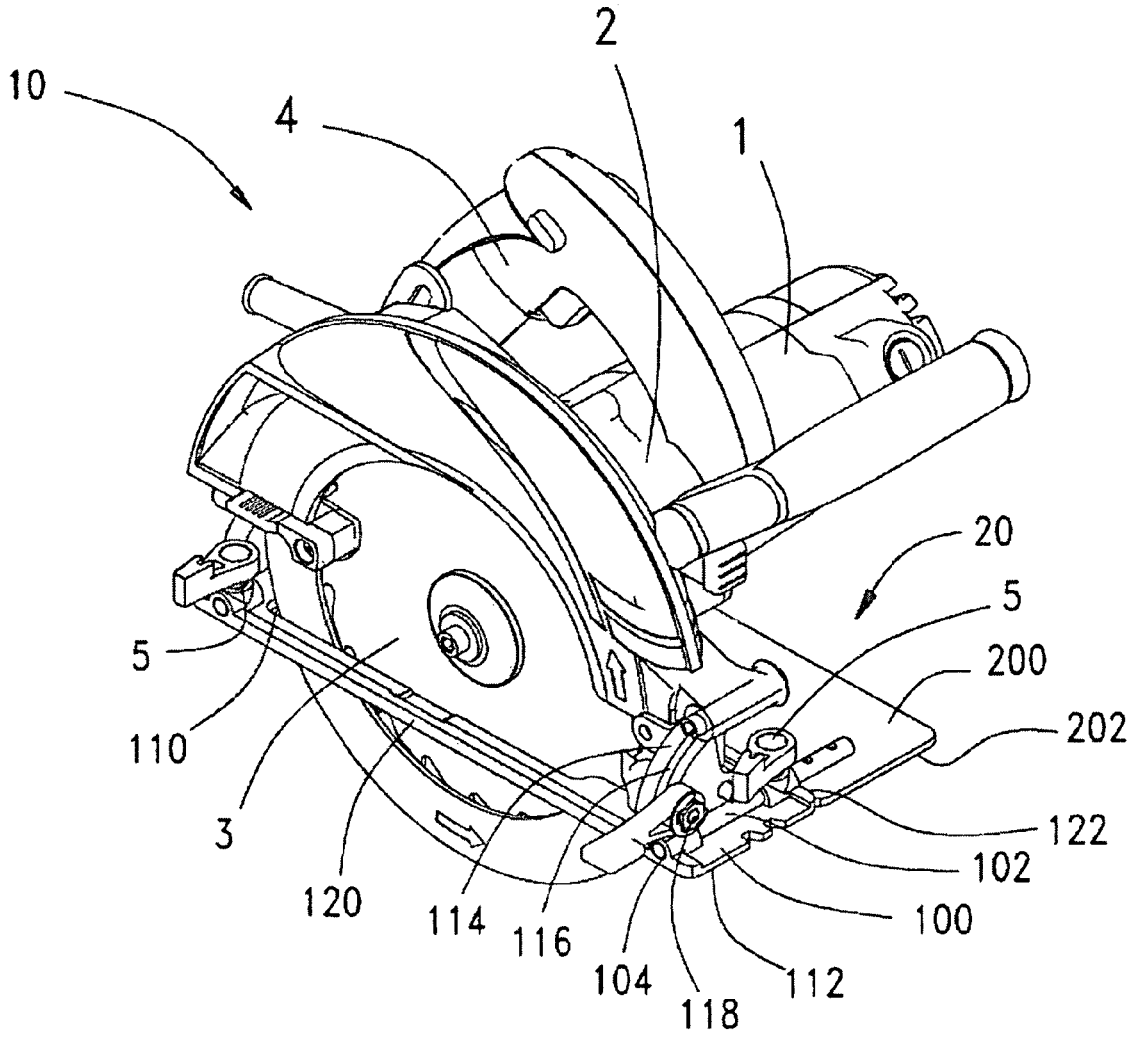
FIG. 3 is a perspective view of the exemplary portable circular saw showing a secondary baseplate jointed to one side of a main baseplate.
Figure 4:
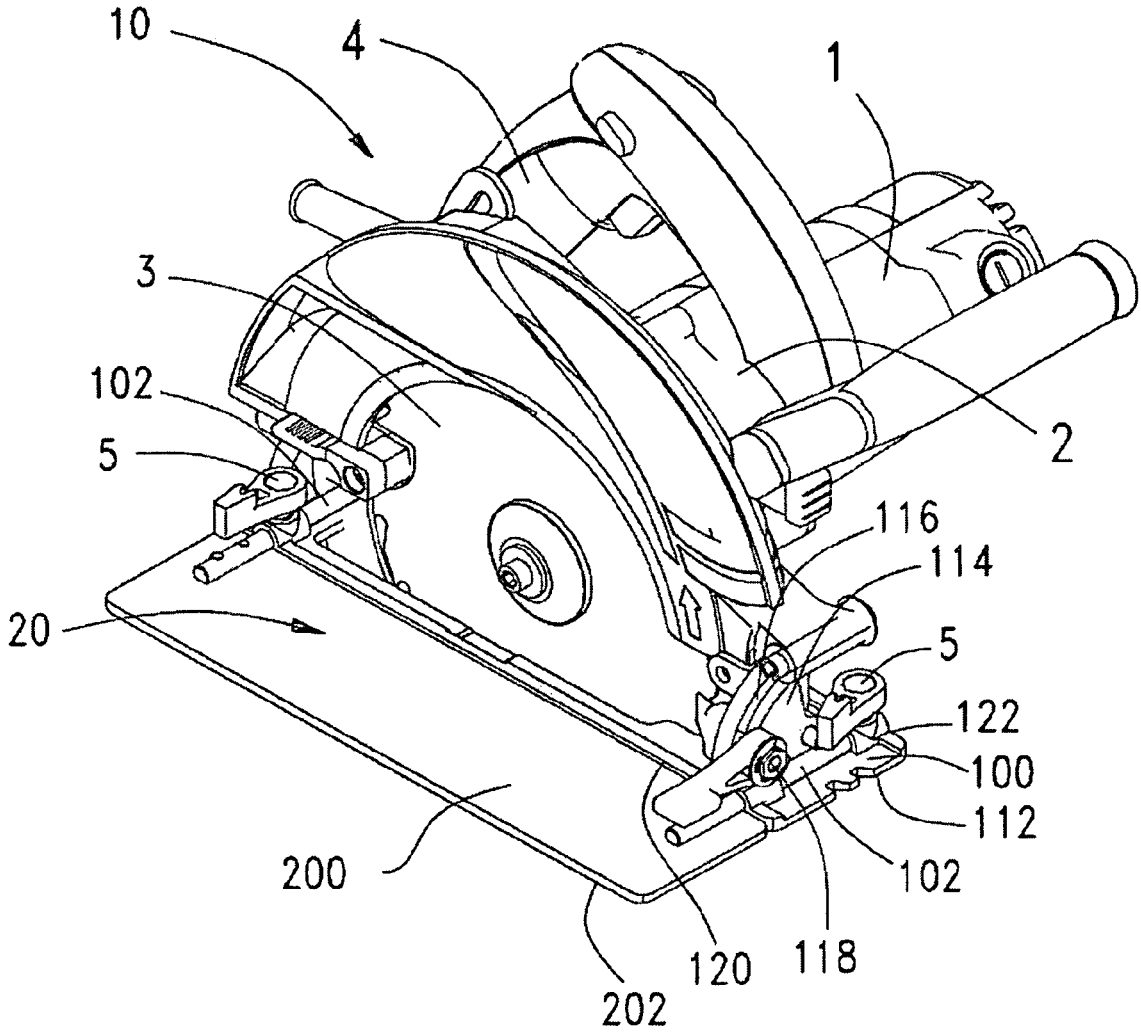
FIG. 4 is a perspective view of the exemplary portable circular saw of FIG. 3 when the secondary baseplate is jointed to the other side of the main baseplate.

With reference to FIG. 3 and FIG. 4 a first embodiment of a portable circular saw includes a housing 10 and a baseplate 20. The housing 10 contains a motor 1 which drives the blade 3 to rotate through a transmission mechanism 2. The circular saw further comprises a handle 4 approximately parallel to the blade 3. The baseplate 20 includes a main baseplate 100 and a secondary baseplate 200. The main baseplate 100 has a slot 110 through which at least a part of the blade 3 passes. The main baseplate 100 comprises a frame 114 which is approximately perpendicular to a bottom surface 112 of the main baseplate 100. An arcuate slot 116 is formed on the frame 114 and a fastener 118 goes through the arcuate slot 116 and is connected to the housing 10. The blade 3 is pivotal around an axis parallel to the bottom surface 112 of the main baseplate 100 and forms a bevel angle therebetween. The blade 3 can be fixed at a different bevel angle relative to the baseplate 20 by the fastener 118 fixing in a different position of the arcuate slot 116. The main baseplate 100 includes a first edge 120 and a second edge 122 which are on opposite side of the blade 3 respectively. Preferably, the two edges 120,122 are approximately symmetrical relative to the blade 3. The secondary baseplate 200 has at least two exchangeable positions. In the first position, shown in FIG. 3, the secondary baseplate 200 is jointed or adjacent to the first edge 120 of the main baseplate 100. In the second position, the secondary baseplate 200 is joined or adjacent to the second edge 122 of the main baseplate 100. The secondary baseplate 200 has a bottom surface 202. The bottom surfaces 112,202 of the main baseplate 100 and the secondary baseplate 200 are coplanar.

A link rod 102 is disposed on the secondary baseplate 200 and a receiving aperture 104 is formed on the main baseplate 100 for receiving the link rod 102. A locking member of the main baseplate 100 fixes the link rod 102 within the receiving aperture 104 to lock the secondary baseplate 200 relative to the main baseplate 100. In this embodiment, the locking member 5 is a screw rod. In other embodiments, the locking member 5 could be a cam or other suitable mechanism as long as the mechanism could fix the link rod 102 within the receiving aperture 104. To dismount the secondary baseplate 200, the locking member 5 is loosened and the secondary baseplate 200 with the link rod 102 is pulled from the receiving aperture 104. Once removed, the secondary baseplate 200 could then be mounted on the other side of the main baseplate 100 via the link rod and locking member as shown in FIG. 4. In some special operation circumstance, for example, to cut a small workpiece or when the operation space is very narrow, the operator could even dismount the secondary baseplate 200 with just the main baseplate 100 remaining and then perform a cutting operation.

The above described preferred embodiments are intended to illuminate the principle of the present invention, but not to limit its scope. It can be easily understood for those skilled in the art that many other modifications and variations of these preferred embodiments will be apparent and may be made without departing from the spirit and the scope of the invention. For example, the connection and fixation of the main baseplate and secondary baseplate is not limit to the manner described and illustrated hereinabove. Rather, many other suitable mechanical connections and fixations are possible, such as by using a plug-in mechanism, clasp mechanism, sliding mechanism, or the like to connect the main baseplate 100 to the secondary baseplate 200. The structure of the locking could also be any one of the structures described above and even the linkage mechanism itself may be provided with a locking function.

Figure 5:
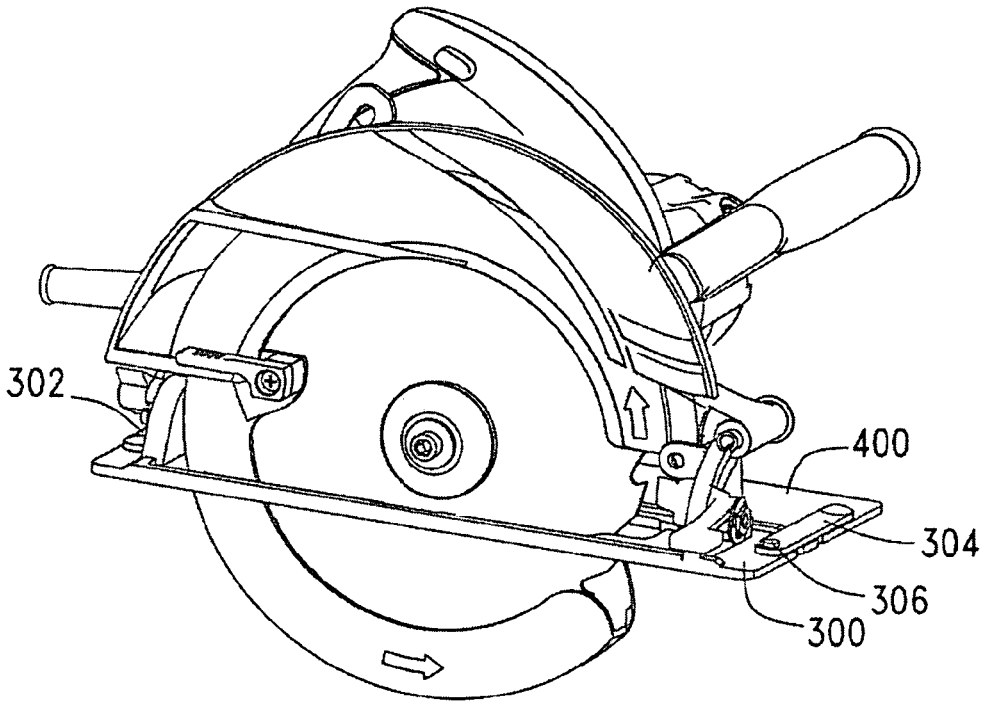
FIG. 5 is a perspective view of the further exemplary portable circular saw showing a secondary baseplate jointed to one side of a main baseplate.
Figure 6:
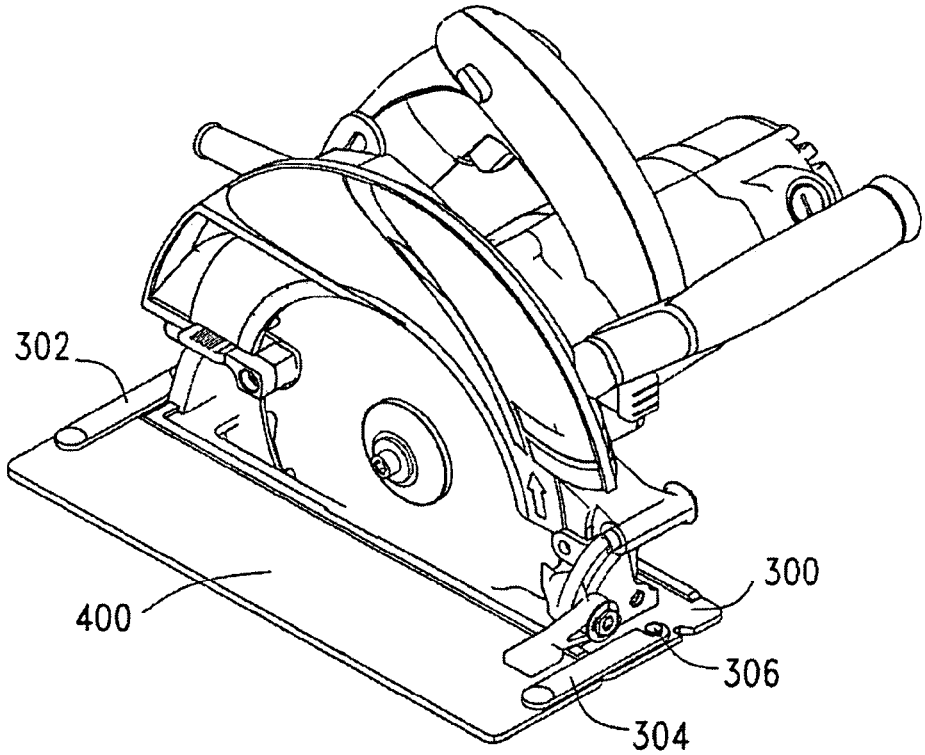
FIG. 6 is a perspective view of the exemplary portable circular saw of FIG. 5 with the secondary baseplate jointed to the other side of the main baseplate.
Figure 7:
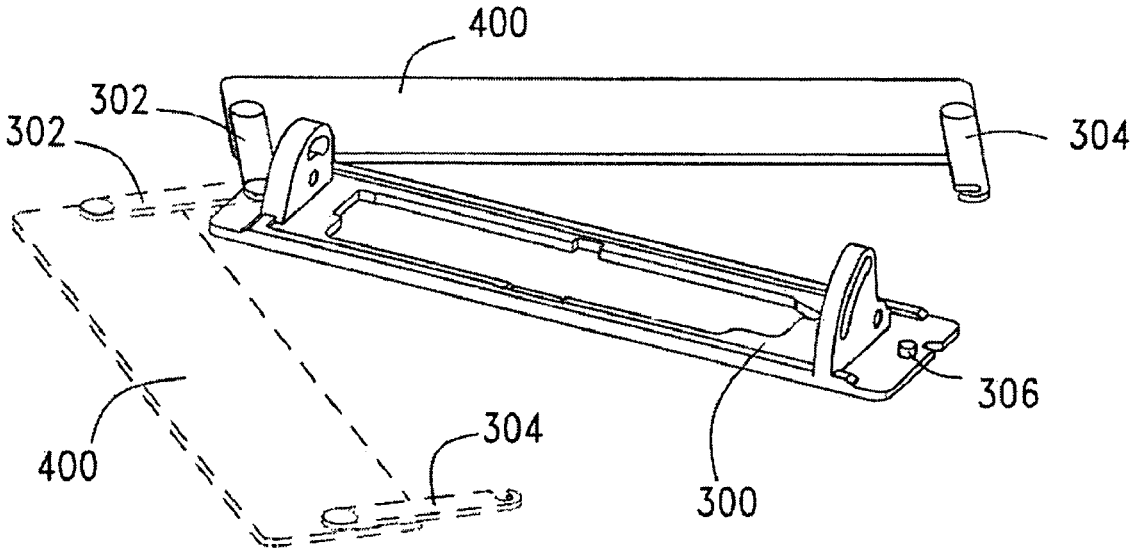
FIG. 7 is a perspective view of a link mechanism between the secondary baseplate and the main baseplate of the exemplary portable circular saw as shown in FIG. 5 and FIG. 6.

Referring to FIG. 5 to FIG. 7, in a further embodiment a linkage 302 is provided, one end of which is pivotally connected to one end of a main baseplate 300 and the other end pivotally connected to one end of a secondary baseplate 400. A hook 304 is pivotally mounted on the secondary baseplate 400 and could be connected to a tack 306 of the main baseplate 300 so as to lock the secondary baseplate 400 relative to the main baseplate 300. Referring to FIG. 7, since the linkage 302 is pivotally connected to the main baseplate 300 and the secondary baseplate 400 respectively, when the hook 304 is demounted from the tack 306, the secondary baseplate 400 could pivot freely to the other side of the main baseplate 300 with the hook 304 be then reconnected to the tack 306 such as to fix the secondary baseplate 400 to the main baseplate 300. In other embodiments, the linkage 302 could be replaced by a hook and a tack. Moreover, the hook 34 could also be mounted on the main baseplate 300 with the tack 306 mounted on the secondary baseplate 400. Still further, the main baseplate and the secondary baseplate could include a tack respectively with an independent and detachable hook being provided to connect the tacks on two ends of the hook. Yet further, the structure and the shape of the hook and the tacks may be varied from those illustrated.

Figure 1:
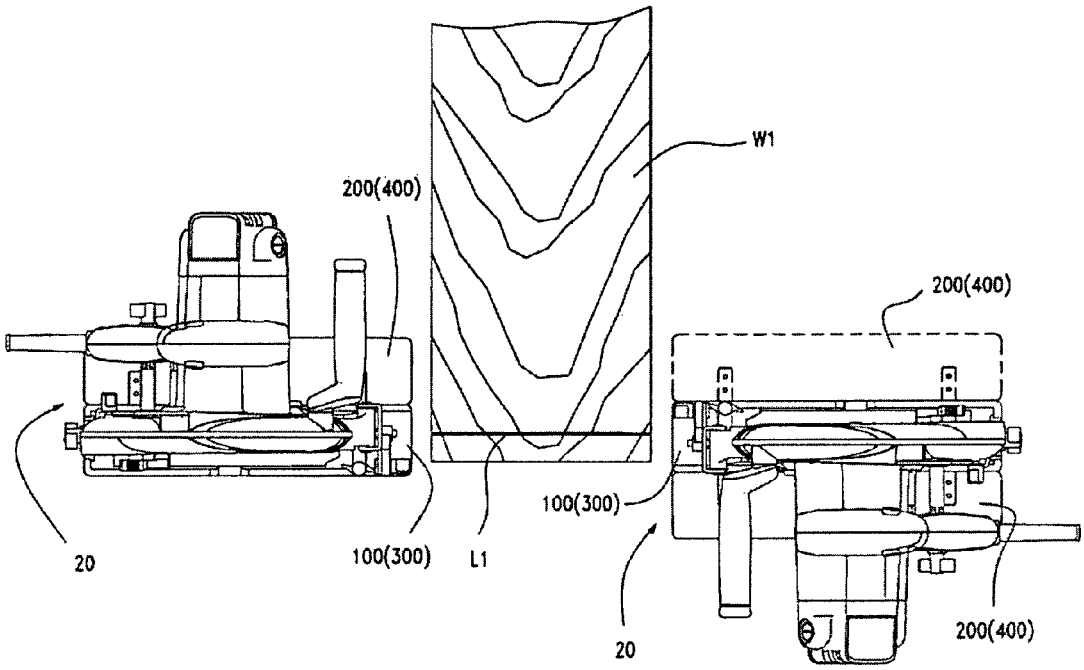
FIG. 1 is a top view of an exemplary portable circular saw constructed according to the subject invention in a first cutting condition.
Figure 2:
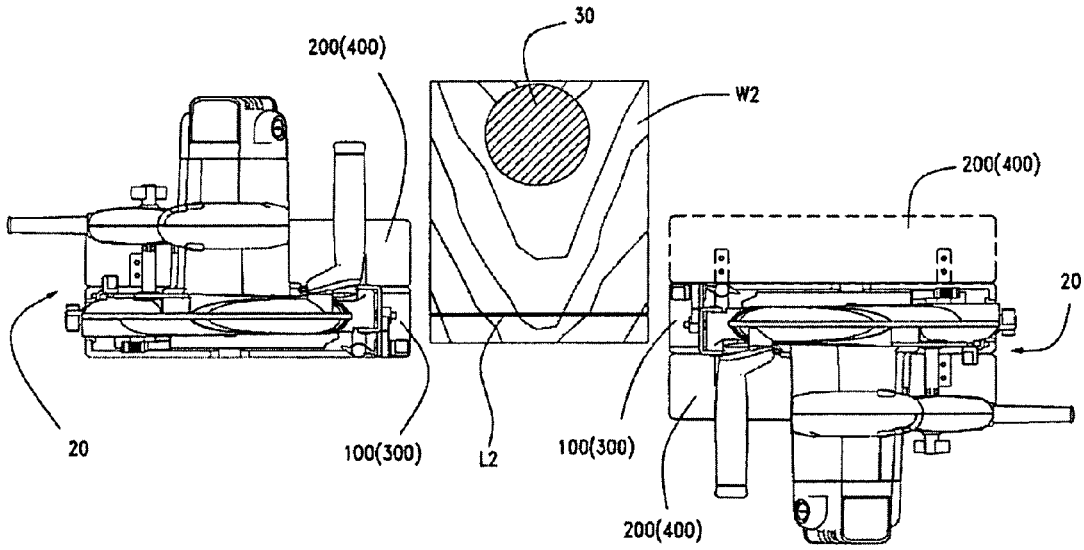
FIG. 2 is a top view of the exemplary portable circular saw in a second cutting condition.

As will be appreciated, the disclosed portable circular saw resolves the problems of operation inconveniences as shown in FIG. 1 and FIG. 2. The operator just needs to dismount the secondary baseplate 200 (400) and mount it on the other side of the main baseplate such as shown by the dotted lines of FIG. 1 and FIG. 2. The sufficient large contacting surface between the baseplate 20 and the workpiece w1 (W2) will thus make the cutting more stabile and precise.

What is claimed is:

1. A portable circular saw, comprising:

a saw body carrying a motor and a blade;

a transmission mechanism for transmitting rotation of the motor to the blade; and a baseplate connected to the saw body which includes a first baseplate and a second baseplate, wherein the first baseplate has a first bottom surface, a first top surface, and a first thickness between the first bottom surface and the first top surface, wherein the second baseplate has a second bottom surface, a second top surface, and a second thickness between the second bottom surface and the second top surface, and wherein the second thickness is the same as the first thickness;

wherein at least a part of the blade passes through an enclosed slot formed in the first baseplate;

the first baseplate includes a first edge and a second edge located on opposing sides of the blade, a front edge, and a rear edge; and the second baseplate has a first position and a second position such that, at the first position, the second baseplate is adjacent to the first edge of the first baseplate and, at the second position, the secondary baseplate is adjacent to the second edge of the main baseplate;

and wherein, in the first position and in the second position, the first bottom surface and the second bottom surface are coplanar, the first top surface and the second top surface are coplanar, and the front edge and the rear edge of the first baseplate are generally aligned with respective edges of the second baseplate.

2. The portable circular saw as set forth in claim 1, wherein at least a link member is connected between the first baseplate and the second baseplate.

3. The portable circular saw as set forth in claim 1, wherein a locking member is disposed on one of the first baseplate and the second baseplate.

4. The portable circular saw as set forth in claim 1, wherein the first edge and the second edge of the main baseplate are approximately symmetrical relative to the blade.

5. The portable circular saw as set forth in claim 1, wherein the first baseplate includes a guide block which is approximately perpendicular to the first bottom surface and a fastener goes through an arcuate slot formed on the guide block and is connected to the saw body.

6. The portable circular saw as set forth in claim 1, wherein a link member is formed on one of the first baseplate and the second baseplate, and a coupling member adapted to couple with the link member is formed on the other of the first baseplate and the second baseplate.

7. The portable circular saw as set forth in claim 6, wherein the link member is a link rod and the coupling member is a receiving aperture.

8. The portable circular saw as set forth in claim 6, wherein the link member is a pivotal hook and the coupling member is a tack.

9. The portable circular saw as set forth in claim 1, wherein the second baseplate is pivotal around one end of the first baseplate.

10. The portable circular saw as set forth in claim 9, wherein a pivotal link member is formed on one of the first baseplate and the second baseplate and a coupling member adapted to couple with the link member is formed on the other of the first baseplate and the second baseplate.

11. The portable circular saw as set forth in claim 1, wherein the first bottom surface and the second bottom surface are the lower most surfaces of the first baseplate and the second baseplate, respectively.

12. The portable circular saw as set forth in claim 1, wherein the first bottom surface encompasses an entirety of the first baseplate and the second bottom surface encompasses and entirety of the second baseplate.

* * * * *